United States Patent [19]

Corcoran

[11] 4,155,139

[45] May 22, 1979

[54] PAINT BRUSH WITH DISPOSABLE APPLICATOR ELEMENT

[76] Inventor: Theodore P. Corcoran, 1745 S. Haster St., Anaheim, Calif. 92803

[21] Appl. No.: 880,102

[22] Filed: Feb. 22, 1978

[51] Int. Cl.[2] ..... A46B 15/00; B05C 17/00

[52] U.S. Cl. ..... 15/244 R

[58] Field of Search ..... 15/151, 244 R, 248 R; 401/203, 204, 130

[56] References Cited

U.S. PATENT DOCUMENTS

| | | | |
|---|---|---|---|
| 1,909,096 | 5/1933 | Cooney | 401/130 |
| 3,002,240 | 10/1961 | Laguerre | 15/151 UX |
| 3,079,628 | 3/1963 | Wright | 401/204 |
| 3,105,263 | 10/1963 | Ginter | 15/244 R |
| 3,366,988 | 2/1968 | Menkin et al. | 15/244 R |

*Primary Examiner*—Daniel Blum

[57] ABSTRACT

A hand painting device is provided which consists of a handle, a flexible extension and a skirt for the containment of a removable polyurethane foam applicator. The skirt or cover contains the applicator and is removably connected to the handle by use of snap extensions on the handle. Pins on the handle help retain the applicator thereon.

1 Claim, 9 Drawing Figures

PAINT BRUSH WITH DISPOSABLE APPLICATOR ELEMENT

BACKGROUND OF THE INVENTION

The invention relates generally to hand paint brushes and applicators for applying paint, varnish, stain and the like to various surfaces.

One advancement in the art is the providing of hand paint applicators that can be removed from the handle and discarded after use. Instead of the user having to undergo costly and bothersome cleaning processes after use, the user simply discards the removable applicator and replaces it on the handle.

Should the user wish to clean and reuse the foam applicator, he may simply remove the foam head from the tongue and handle and the applicator can be easily cleaned and can be cleaned faster and more thoroughly than if on the handle.

Accordingly, one object of the invention is the providing of an improved paint brush. Another object of the invention is to provide an improved removable applicator hand paint device. Other objects of the invention will be apparent from the following description.

The invention can be understood by reference to the following drawings.

Figure 1:
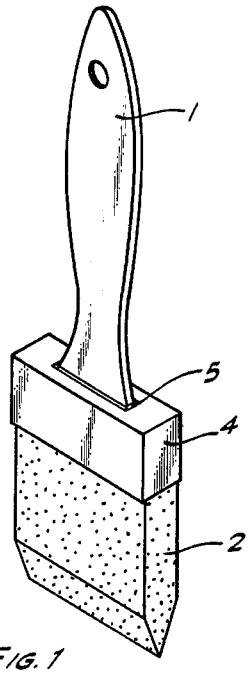
FIG. 1 shows a perspective view of the paint brush of the invention.

FIG. 1 is a perspective view of the applicator 2 intact with the skirt or cover 4 which is also removably connected to handle 1. As can be seen, the applicator is inserted inside skirt or cover 4 which is removably attached to the handle 1.

Applicator 2 is of foam material and differs from the standard "brush" applicators. Polyurethane foam is the most popular as are other type synthetic applicators or rubber-type applicators. Such applicators are well-known in the art.

Figure 2:
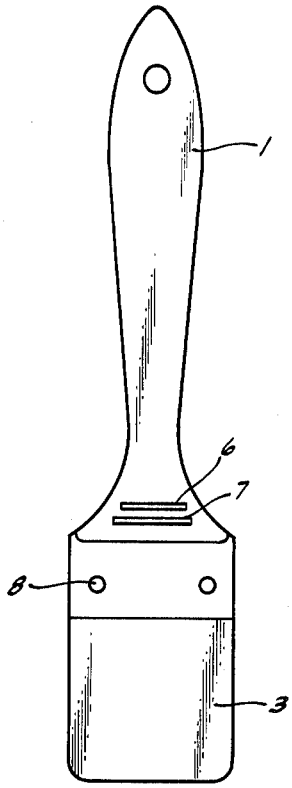
FIG. 2 shows a front view of the brush of this invention without the applicator.

FIG. 2 shows a plane view of the handle 1 which is integral with flexible extension 3. Flexible extension 3 is a thin flexible "tongue" which is made of the same plastic mold as is handle 1 or permanently attached to handle 1. The upper portion of the extension 3 may be but need not be thicker than the bulk portion of extension 3. The extension 3 as is the handle 1 is made of plastic material but can be made of wood or any other material. The extension 3 is, however, flexible for maximum painting ability.

Figure 3:
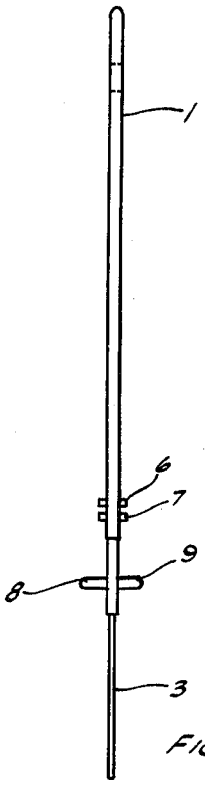
FIG. 3 shows a side view of the invention without the applicator.

FIG. 3 is a side view of the same device shown in FIG. 2. Pins 8 and 9 are shown integral to the plastic device and protrude from the upper portion of extension 3. For a narrow brush (1" size), there is a minimum of two pins, one on each side of the extension. Additional pins are provided for wider brushes. The pins are integral, i.e. in the same mold, as the entire device which is depicted in FIGS. 2 and 3.

For wider brushes, i.e. two inches (2") or wider, two pins on each side of the extension are suitable. The number of pins depends, of course, on the particular desires of the manufacturer and of the user.

Also shown in FIGS. 2 and 3 are snap-on extensions 6 and 7, hereinafter referred to as "protuberances". The "snap-on" is simply a short plastic longitudinal extension or ridge. The snap-ons are two in number on each side of the lower part of the handle so that the skirt 4 at the opening 5 can "snap-on" between snap-ons 6 and 7 so as to removably secure the skirt 4 to handle 1.

In operation, the skirt 4, made of the same plastic material as is handle 1 and extension 2, can be removed from the handle 1 by simply forcibly removing it from between snap-on 6 and 7. The pins 8 and 9 are such that they extend to the interior of skirt 4 and displace portions of the foam applicator. In such fashion, the foam applicator is held within the skirt 4 and onto the pins 8 and 9. When the user desires to remove the foam applicator, he presses the side of the skirt towards the handle and the skirt is removed from the extension. The applicator can then be taken off the pins. The skirt is then moved up the handle so that the foam applicator can be removed. The width of the handle 1 is such that the skirt cannot be completely removed from the handle unless force is exerted with the intention of completely removing the skirt or cover 4. The snap-ons 6 and 7 are simply longitudinal extensions of the same mold as the handle 1 with the upper snap-on being slightly shorter than the lower snap-on although in practice both can be the same or one can be shorter than the other. The protrusion of the snap-ons is much less than the pin protrusion as can be observed from the drawings.

Figure 4:
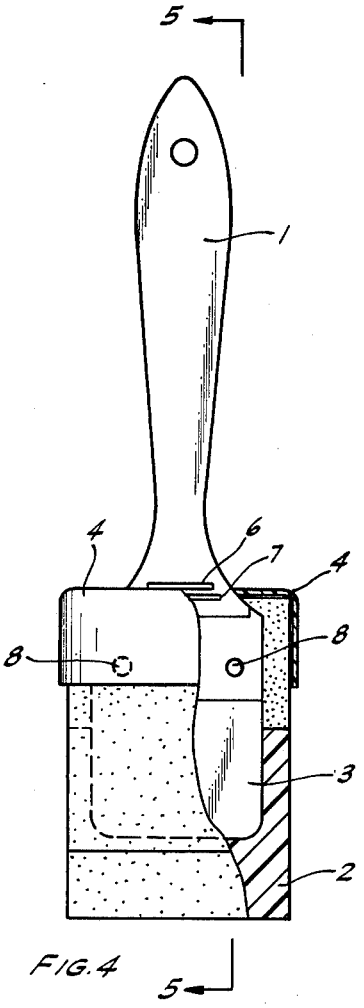
FIG. 4 shows a front view of the invention with cut-a-ways of the tongue and applicator.
Figure 5:
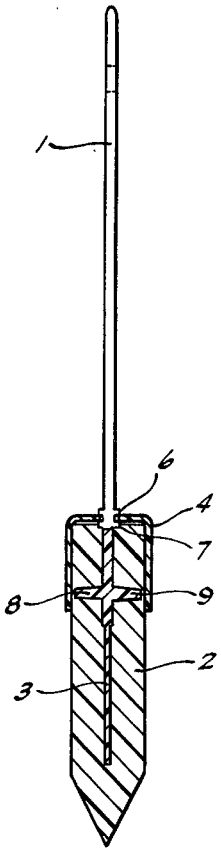
FIG. 5 shows cross-sectional view of the invention with the applicator.

FIG. 4 and FIG. 5 illustrate the invention with the foam applicator in place.

The foam applicator 2 is shown in place by being intact with pins 8 and 9. Holes can be fitted in foam applicator for such placement or pins 8 and 9 simply intrude within the foam applicator. The foam applicator extends upwards within the skirt 4. The skirt 4 is shown captured by the two snap-ons 6 and 7. It can be seen that if the user indents the flexible plastic skirt or cover 4, the upper portion can simply "snap-out" of the snap-ons and can then be slid up the handle for removal of the foam applicator.

Figure 8:
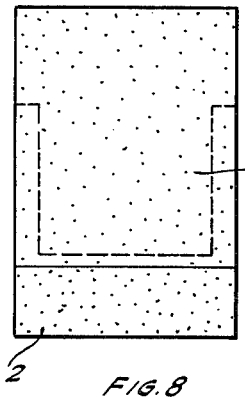
FIG. 8 shows a front view of the applicator.
Figure 9:
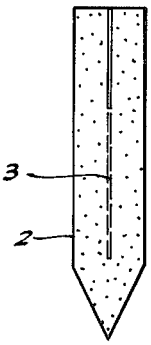
FIG. 9 shows a side view of the applicator.

FIGS. 8 and 9 show views of the foam applicator 2. The foam applicator itself has a slot or opening in the middle of the foam applicator. As shown, the foam applicator tapers to one edge. Thus the extension can be easily inserted in the applicator. As shown, there is a partial split in the upper section of the foam applicator so that the user can easily remove the applicator by lifting the applicator from the pins.

Figure 6:
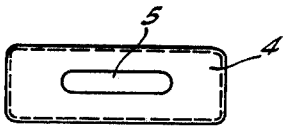
FIG. 6 shows a top view of the plastic skirt.
Figure 7:
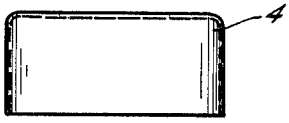
FIG. 7 shows a side view of the plastic skirt.

FIGS. 6 and 7 show, in detail, the flexible, plastic cover or skirt 4. There is an opening 5 so that the skirt can be inserted mounted on the handle 1 and can freely move up and down handle 1 as desired by the user.

According to the invention, the foam applicator is mounted on the extension 3 and onto pins 8 and 9. The skirt or cover 4 is then brought down handle 1 and placed in position using snap-ons 6 and 7. Since there is little or no distance between pins 8 and 9 and the interior of the skirt cover, the foam applicator is held permanently intact. The user is then free to apply paint to the applicator. After painting is terminated, the user simply pushes in on the side of the skirt or cover 4 and removes the skirt or cover 4 from the pins 8 and 9 with the skirt or cover 4 being placed upwards on handle 1.

The foam applicator is then removed from the pins 8 and 9 and replaced with another applicator as desired.

As stated, the foam applicator can be made of any spongy material which absorbs paint, varnish or the like. Polyurethane is the most popular although other synthetic resins or plastics such as polyesters may be utilized. The remainder of the device is made of plastic such as polyethylene, polyproplene or the like.

I claim:

1. A paint, varnish, stain or the like hand applicator device comprising:

(a) a handle integral with a flexible, thin plastic tongue extension;

(b) at least two perpendicularly projecting pins integral with said extension;

(c) at least two plastic protuberances upwards of said pins and integral with said handle;

(d) a plastic skirt;

(e) a foam applicator;

(f) an opening in said plastic skirt so that such skirt is mounted on said handle over its free end and can be freely moved up and down such handle; such skirt adapted to lock between said two protuberances at its opening; and (g) a slot in the middle of said applicator opening at its top, said slot receiving said extension, the upper part of the applicator housed within the skirt and engaged by the pins.

* * * * *